United States Patent [19]

Ohashi

[11] 3,940,077

[45] Feb. 24, 1976

[54] APPARATUS FOR AND A METHOD OF YARN DOFFING

[75] Inventor: Kenji Ohashi, Uji, Japan

[73] Assignee: Murata Kikai Kabushiki Kaisha, Kyoto, Japan

[22] Filed: Aug. 6, 1973

[21] Appl. No.: 385,744

[52] U.S. Cl. ..... 242/35.5 A; 242/18 A

[51] Int. Cl.[2] ..... B65H 54/20; B65H 67/04

[58] Field of Search ..... 242/35.5 R, 35.5 A, 35.6 R, 242/18 R, 18 A; 57/53

[56] References Cited

UNITED STATES PATENTS

| | | | |
|---|---|---|---|
| 3,092,340 | 6/1963 | Furst | 242/35.5 R |
| 3,160,359 | 12/1964 | Furst | 242/35.5 R |
| 3,307,794 | 3/1967 | Furst | 242/35.5 R |
| 3,356,306 | 12/1967 | Furst | 242/35.5 R |
| 3,476,328 | 11/1969 | Shimai et al. | 242/35.5 R |
| 3,507,453 | 4/1970 | Scragg et al. | 242/18 R |
| 3,682,403 | 8/1972 | Willis | 242/18 A |
| 3,791,126 | 2/1974 | Kose et al. | 57/53 |

*Primary Examiner*—Stanley N. Gilreath
*Attorney, Agent, or Firm*—Whittemore, Hulbert & Belknap

[57] ABSTRACT

Structure for doffing yarn in a yarn winding machine and by a method such that when a full package of yarn is formed at each winding unit of the yarn winding machine, a driving guiding drum for the winding unit is braked while an engaging shutter plate is moved to open a cradle arm to drop the full package on an inclined guide plate for transfer to a conveyor. An empty spool container on each winding unit then supplies an empty spool to the cradle arm by means of an empty spool carrier. The whole process is controlled by cam means actuated by a one-revolution clutch.

6 Claims, 13 Drawing Figures

APPARATUS FOR AND A METHOD OF YARN DOFFING

BACKGROUND OF THE INVENTION

1. Field of the Invention

The present invention relates to a yarn winding machine, and more specifically to a doffing apparatus of an automatic winding machine having a frame, a plurality of winding units each carrying a yarn package, and conveying means to transport a full package.

In a known yarn winding machine having a plurality of winding units which move along an annular rail while winding, it is customary to perform the doffing operation at a stationary position by the rail. However, to perform the doffing operation separate from the winding units, each winding unit must wait to reach the doffing apparatus without the winding operation after a full package is formed at a random point along the rail, so that the operation time of the winding unit is decreased. Also, in the known machines, the doffing operation must be performed after a full package is removed from the guiding drum of the winding unit, so that the doffing interval, i.e., from the stopping of winding to restarting of winding, is relatively long.

2. Description of the Prior Art

U.S. Pat. No. 3,476,328 discloses a winding unit, in which the cradle arm is moved upwards to separate from the winding drum by engaging the end portion of the cradle arm with a cam. U.S. Pat. No. 3,311,311 discloses a winding unit, in which a horn-like arm is inserted under the spool to transfer the spool on the arm so that the spool is disengaged from the winding drum. These apparatus must provide means to vary the arm movement in accordance with the diameters of the full package. Also in U.S. Pat. No. 3,476,328 and U.S. Pat. No. 3,356,306 there are taught swing arms to push out the full package. However, the full package must be stopped after being disengaged from the guiding drum, so that some time loss is inevitable. Further, U.S. Pat. No. 3,476,328 provides a yarn guide wherein the package receiver and the cutter are separated, so that the yarn guide can miss and consequently a yarn connected package might be produced.

SUMMARY OF THE INVENTION

The object of the present invention is to provide a doffing method and doffing apparatus which can be mounted on each stationary winding unit of a winding machine to mitigate the aforementioned disadvantages.

In general, when a full package is formed on the guiding drum of each winding unit, yarn winding is stopped immediately and by braking the guiding drum. The full package is removed from the guiding drum. Then, an empty spool contained in the winding unit is supplied to the cradle arm. The removed full package is transferred along the guide plate of each winding unit to a common conveyor means.

According to the present invention, a doffing apparatus of the above mentioned automatic winding machine comprises guiding drum means contacting the periphery of the package to drive the same, guide plate means guiding said full package to the conveying means, brake means engageable with the guiding drum means to stop the guiding drum, means operably connecting the guiding plate with said brake means, means to move the guiding plate to actuate the brake means while the guiding drum is still engaging the full package, cradle means supporting the package, shutter plate means to open the cradle means to release the full package, yarn transfer means mounted on said guide plate to transfer the yarn connected with said full package, cutter means to cut said yarn transferred by said yarn transfer means, and empty spool carrier means to carry an empty spool to said cradle means to be supported by the cradle means.

To control the whole doffing process, according to a preferred embodiment of the present invention, the doffing apparatus further comprises first cam means to open and close switch means actuating said guiding drum, second cam means to swing said empty spool carrier means, third cam means to move said shutter plate, fourth cam means swinging said yarn transfer means, shaft means connecting said first to fourth cam means in one unit, and one revolution clutch means to connect said shaft means with said first to fourth cam means.

In the doffing method of the present invention for an automatic winding machine as indicated, when a spool supported by the cradle means is a full package, while the guiding drum is driving the package by contacting the periphery of the package, a guide plate is moved to actuate the brake means to stop the guiding drum and the package, then a shutter plate is swung to open the cradle means to release the full package onto the guide plate, said released full package being then moved on the conveying means, while at the same time the yarn transfer means is actuated to transfer the yarn connected with the full package sidewise to yarn cutter means, and an empty spool is carried by an empty spool carrier to the cradle means.

DESCRIPTION OF THE PREFERRED EMBODIMENT

Figure 1:
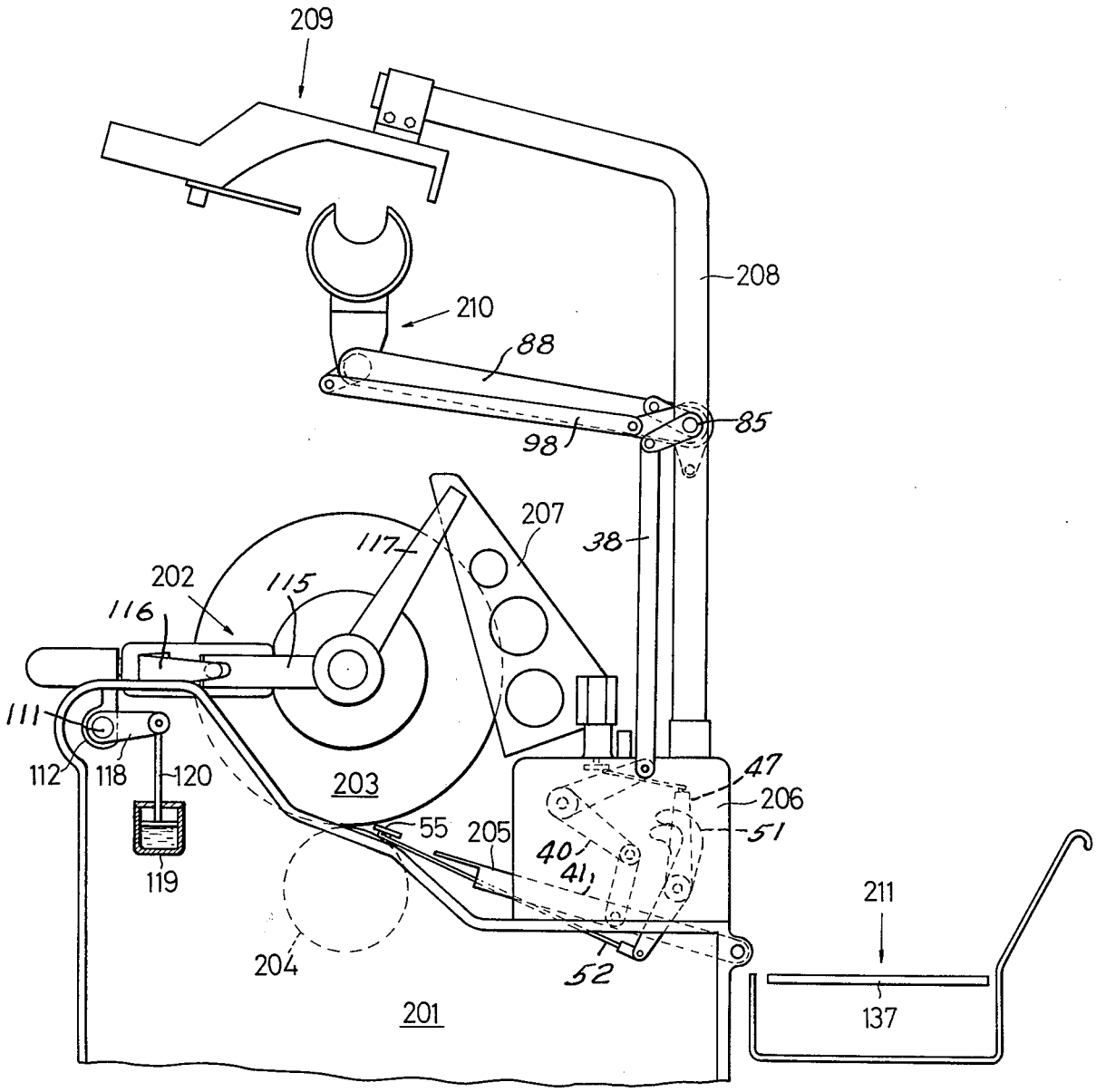
FIG. 1 is a side elevational view of the upper portion of the unit winder of the yarn winding machine of the present invention.

A unit winder of a yarn winding machine according to one embodiment of the present invention is shown in FIG. 1 and comprises a base 201, a cradle assembly 202 supporting a package 203, a guiding drum 204 for rotating the package 203 by engaging the periphery of the package, a guide plate assembly 205 to guide a full package released from the cradle assembly 202, and a doffing cam box 206. A shutter plate 207 is pivotably mounted on the doffing cam box 206 to engage a portion of the cradle 202 to open or close the same. A pole 208 which supports the empty spool container 209 is secured to the doffing cam box 206. An empty spool carrier 209 is supported by the pole 208. a conveyor means 211 for conveying a full package 203 is provided in back of the base 201.

FIGS. 2–6 show the doffing cam box 206. A stationary shaft 1 rotatably supports a gear 2 and cams 3, 4, 5, 6, 7 and 8 which are secured as a unit. The gear 2 meshes with a one revolution clutch 9 shown in FIG. 4. The one revolution clutch 9 comprises a tubular body 14 which is secured to a shaft 11 of a motor 10 by a key 15. One surface of a flange of the tubular body 14 forms friction plate 13. Another friction plate 16 opposite the friction plate 13 is slidably mounted on the tubular body 14 and is urged towards the friction plate 13 by a spring 18 engaged between the friction plate 16 and nut means 17 secured to the tubular body 14. Between the friction plates 13 and 16, a gear 21 having a cam 20 forming recess 19 is rotatably inserted. A pawl 23 is urged towards the cam 20 by a spring 22. The pawl 23 is pivoted about a pivot pin by a rod 25 of a solenoid 24.

Another stationary shaft 26 is secured in the doffing cam box 206 and rotatably supports levers 27 and 28. The levers 27 and 28 are urged by springs 29 and 30 respectively to rotate counterclockwise in FIG. 3. Thus, the lever 27 is urged towards the cam 3. When the lever 27 engages the projection 31 of the cam 3, the lever 27 rotates clockwise so that the other arm 32 of the lever 27 disengages from a microswitch 33 secured in the doffing cam box 206 to actuate the guiding drum 204. The lever 28 is urged toward the cam 4. When the lever 28 moves into the recess 34 in the cam 4, the cams 3, 4, 5, 6, 7 and 8 are stopped at a predetermined position.

Figure 2:
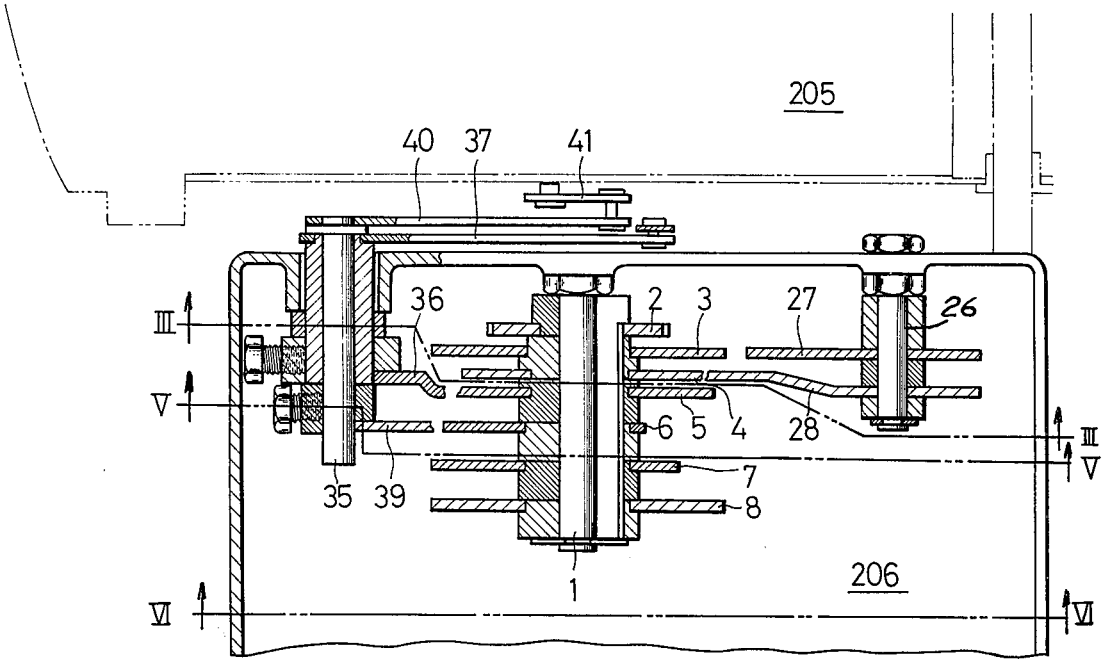
FIG. 2 is a longitudinal sectional view of the doffing cam box of the unit winder shown in FIG. 1 corresponding to a section taken along line II—II of FIG. 3.
Figure 5:
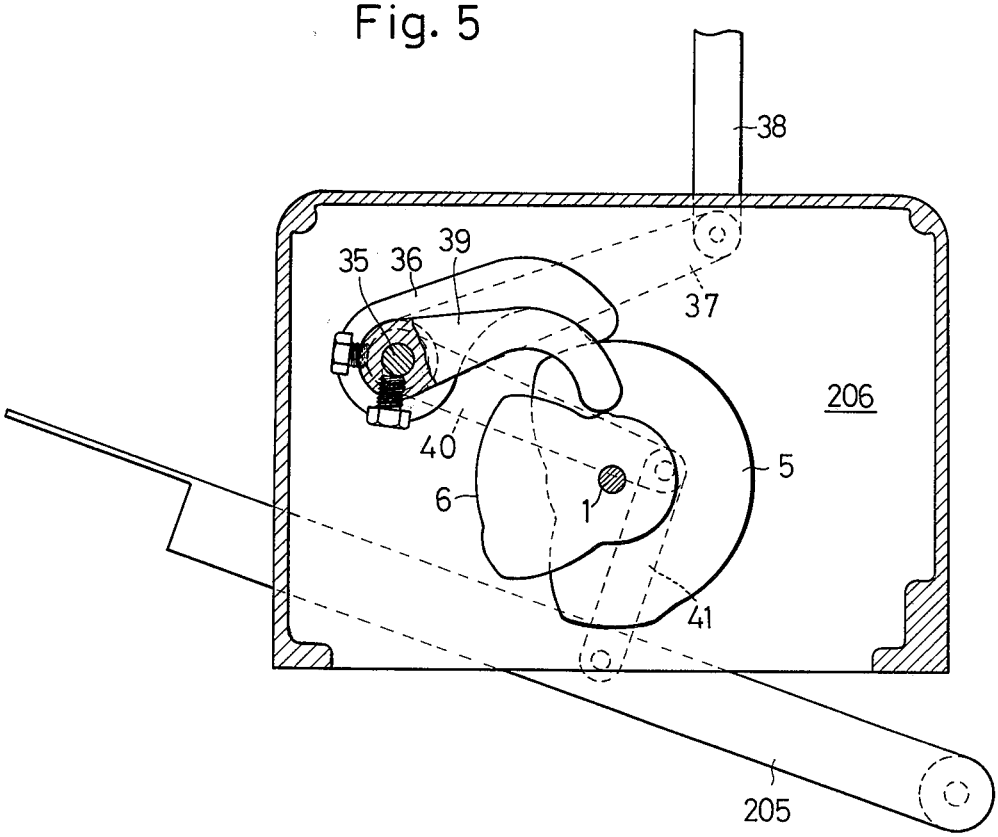
FIG. 5 shows a sectional view taken along line V—V of FIG. 2, a portion of which is eliminated.

As shown in FIGS. 1, 2 and 5, a stationary shaft 35 is secured in the doffing cam box 206. A lever 36 is rotatably supported on the shaft 35 and is urged toward the cam 5. A lever 37 secured to the lever 36 is positioned outside the doffing cam box 206 and is rotated with the lever 36 and actuates a vertical lever 38 connected with the empty spool carrier 210. Another lever 39 is rotatably supported on the shaft 35 and is urged toward the cam 6. A lever 40 outside the doffing cam box 206 is secured with the lever 39. The lever 40 rotates the guide plate 205 through a connected link 41. The levers 36 and 39 are actuated independently by the cams 5 and 6, respectively.

Figure 6:
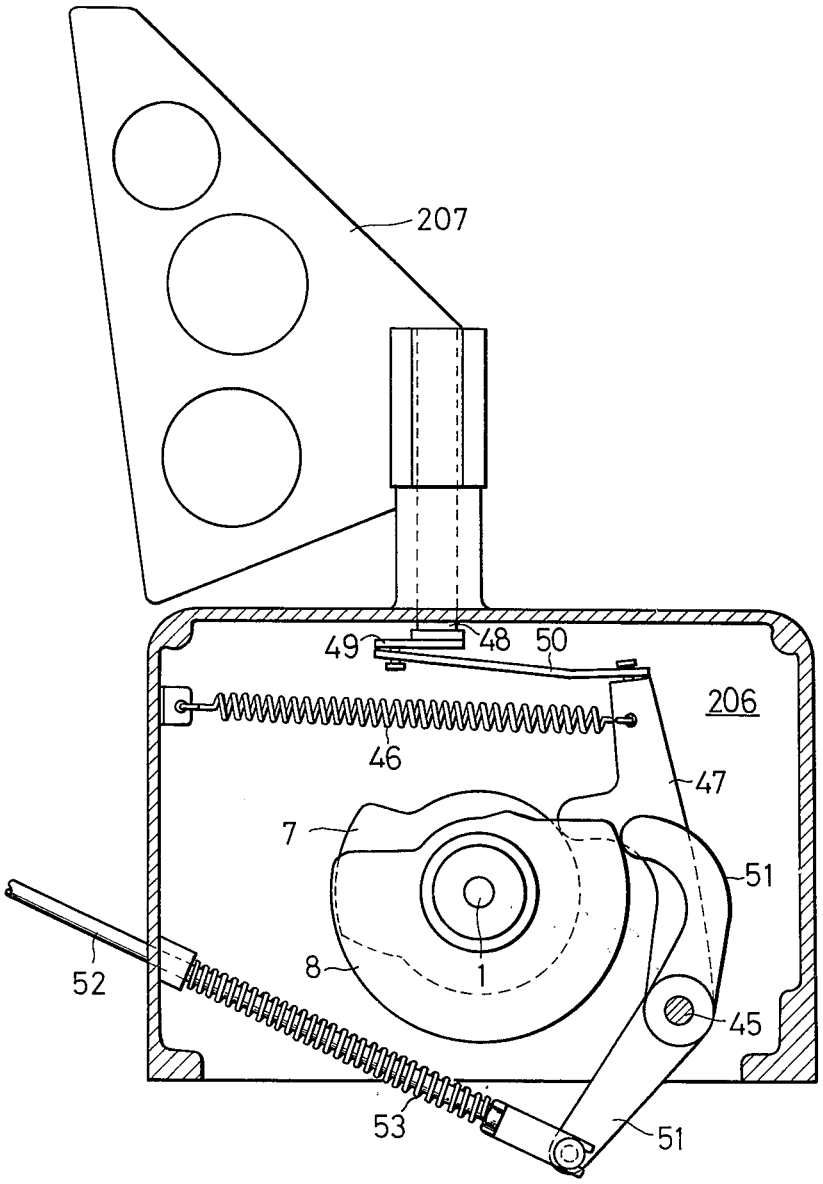
FIG. 6 shows a sectional view along line VI—VI of FIG. 2, a portion of which is eliminated.

Another stationary shaft 45 is secured in the doffing cam box 206 as shown in FIG. 6 and rotatably supports a lever 47 which is urged toward the cam 7 by a spring 46. A shaft 48 is rotatably supported by the doffing cam box 206 and integrally secured to lever 49 at one end. The lever 49 is connected with the lever 47 through a link 50. The shutter plate 207 is secured to shaft 48.

Another lever 51 is rotatably supported on the stationary shaft 45 and is urged toward the cam 8. A rod 52 is pivotally attached to the other end of the lever 51. A coil spring 53 on the rod 52 urges the lever 51 into engagement with the cam 8 through the pivot pin of the rod 52. The rod 52 is connected with a second yarn transfer lever 55 pivotally supported on a shaft 54 shown in FIG. 8.

Figure 7:
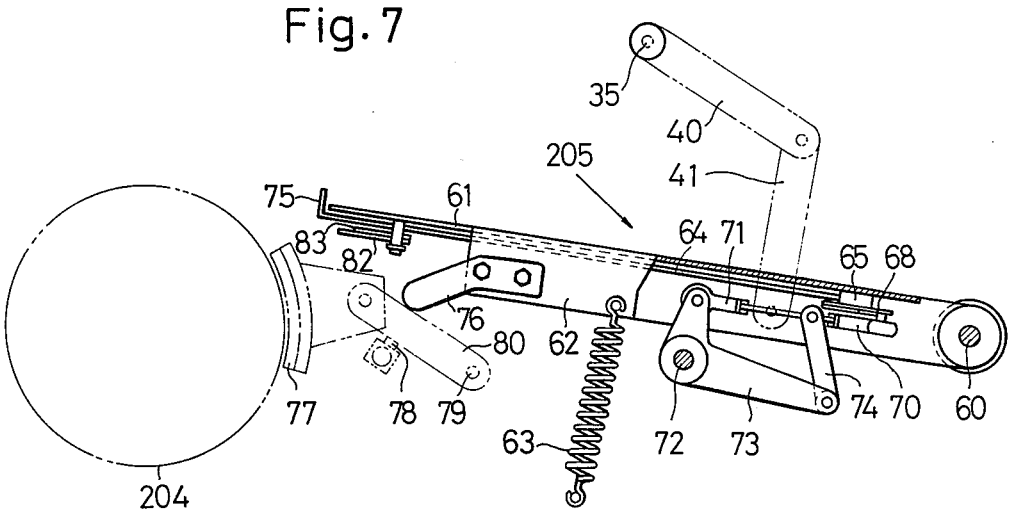
FIG. 7 shows a detailed side elevational view of the guide plate assembly shown in FIG. 1.
Figure 8:
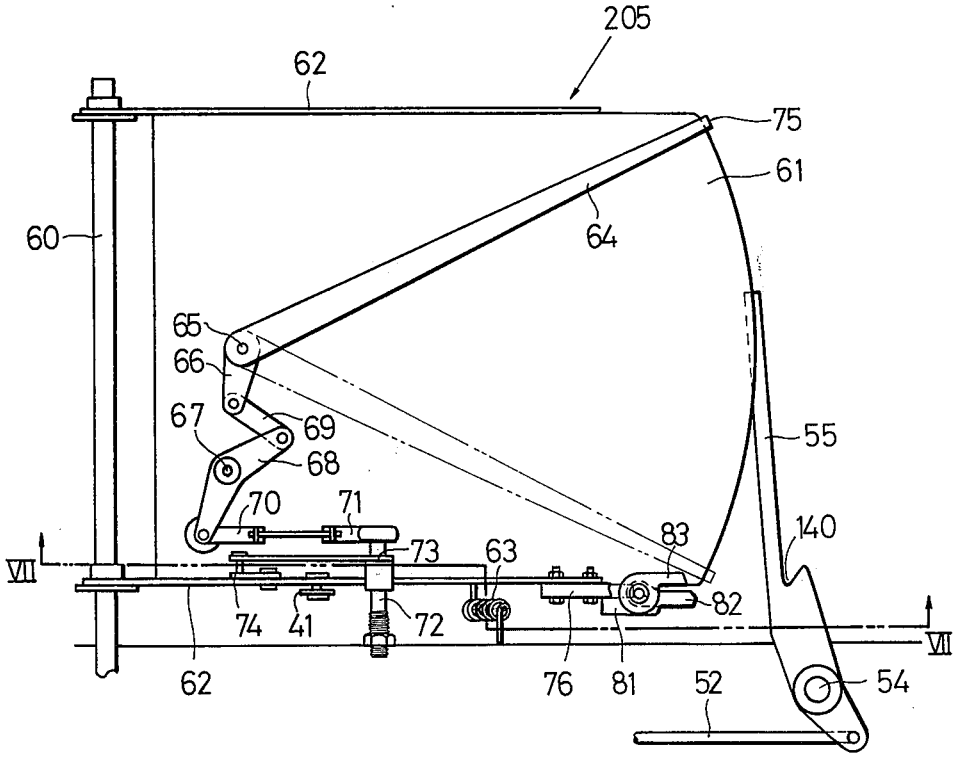
FIG. 8 shows a bottom view of the guide plate assembly shown in FIG. 7.

FIGS. 7 and 8 show details of the guide plate 205. A stationary shaft 60 secured to the frame 201 rotatably supports a guide plate 61 which provides a side plate 62 on which one end of the lever 41 is pivotably supported. A spring 63 engaged with the side plate 62 urges the guide plate counterclockwise to pull the lever 41 downward in FIG. 7. Thus, the lever 40 and the integral lever 39 are urged into engagement with the cam 6. Accordingly, as the cam 6 rotates, the guide plate 61 is rocked about the shaft 60. At the lower side of the plate 61, a shaft 65 is secured and pivotally supports a first yarn transfer lever 64. The free end of the guide plate 61 is formed as an arc which aligns with the trace of the free end of the lever 64 when the lever 64 is oscillated.

A lever 66 is secured with the first yarn transfer lever 64 and is connected through a lever 69 with a lever 68 which is pivotally supported on a shaft 67 which in turn is secured to the lower side of the guide plate 61. The other end of the lever 68 is connected through universal moint means 70 and 71 with an L-shaped rod 73 which is supported by a shaft 72 supported in base 201 or cam box 206. The other end of the L-shaped rod 73 is connected to a lever 74 which is pivotally supported on the side plate 62 of the guide plate 61.

A projection 76 is secured to the end of the side plate 62 by stop screw means. A brake lever 80 is pivotally supported by a shaft 79 which is secured to the frame and in turn pivotally supports at the free end a brake shoe 77 which engages the periphery of the guiding drum 204. The brake lever is urged by a plate spring 78 to release the guiding drum 204 and when it is engaged by the projection 76 the brake lever is pivoted to cause brake shoe 77 to brake the drum 204.

A lug 81 is formed at the side edge of the guide plate 61 and cutters 82 and 83 are mounted on the lug 81. The cutter 82 is normally urged by a spring, not shown, to disengage from the cutter 83, and is engaged by a portion of the cradle 202, when the arm of the cradle 202 is closed to cut the yarn, as will be described more fully hereinafter.

Figure 9:
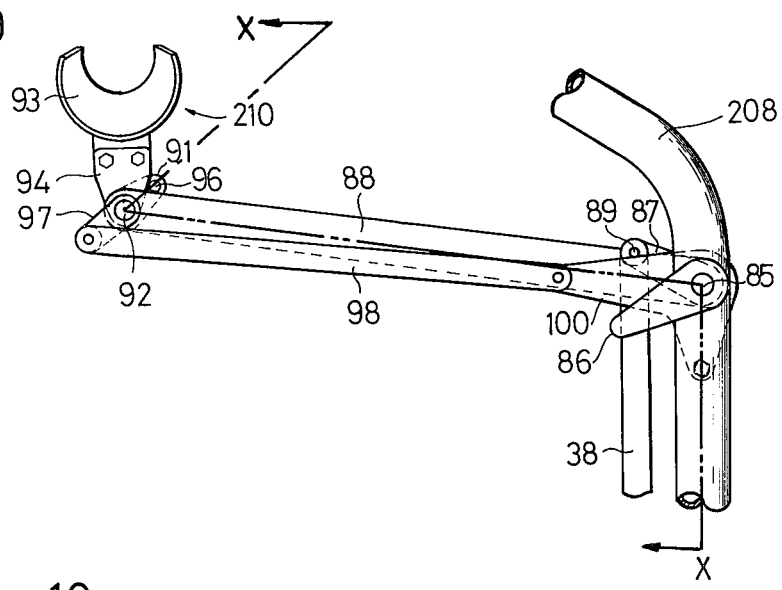
FIG. 9 shows a detailed side elevational view of the empty spool carrier shown in FIG. 1.
Figure 10:
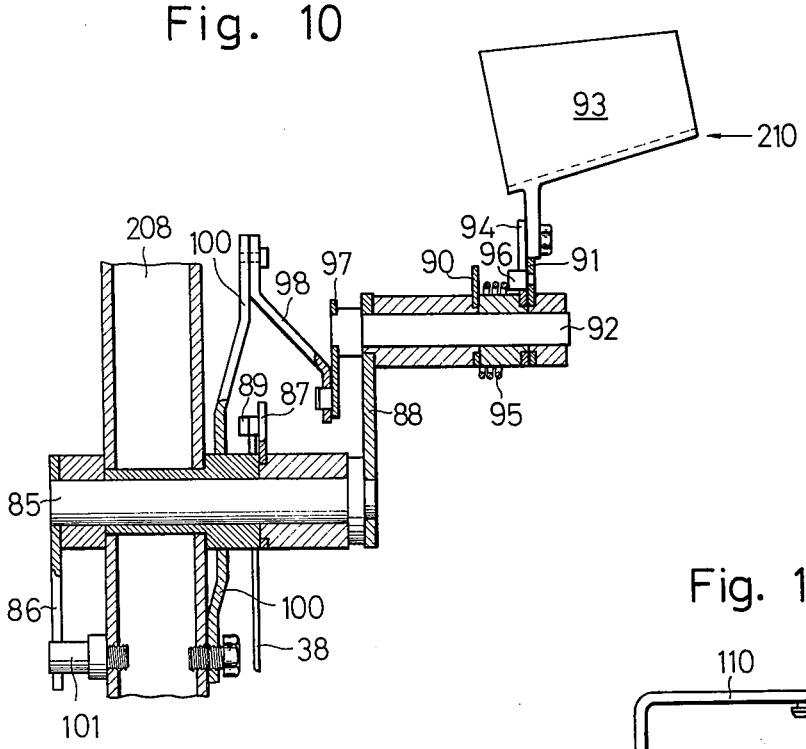
FIG. 10 shows a sectional view taken along line X—X of FIG. 9.

The empty spool carrier 210 is shown in detail in FIGS. 9 and 10. The pole 208 rotatably supports a shaft 85 to which are secured levers 86, 87 and 88. One end of the aforementioned vertical lever 38 is pivoted to the lever 87 by a pin 89. The free end of the lever 88 rotatably supports a shaft 92 to which are secured levers 90 and 91. The shaft 92 rotatably supports a lever 94 which is secured to an empty spool holder 93 which is made in a frustoconical shape of elastic material such as rubber. The lever 94 is urged toward a pin 96 which is secured with the lever 91 by a conical spring 95 which is wound about the shaft 92. One end of the spring is secured with the lever 90. Further, a lever 97 is secured with the shaft 92 which is connected through link 98 to a lever 100 which is secured to the pole 208. When the shaft 85 is rotated, the lever 86 engages a stop 101 which is secured to the pole 208 and defines the lower limit of the empty spool holder 93.

Figure 11:
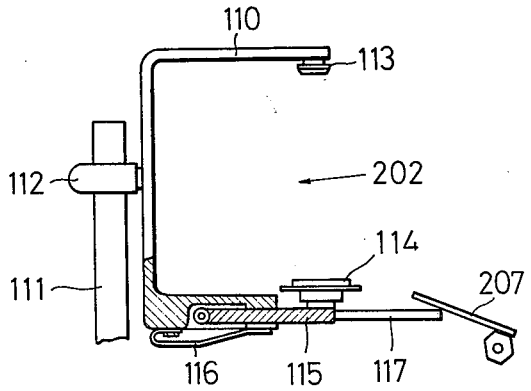
FIG. 11 shows a detailed horizontal sectional view of the cradle assembly shown in FIG. 1.

The cradle 202 is shown in detail in FIGS. 1 and 11. A shaft 111 secured with the frame rotatably supports a U-shaped cradle arm 110 through a bracket 112. One leg of the cradle arm 110 has a rotatable spool support 113, and the other leg thereof pivotally supports a lever 115 which provides another rotatable spool support 114. The lever 115 is urged to the spool engaging position by a spring 116 and provides at the free end thereof a projection 117 to engage the shutter plate 207. The bracket 112 has attached thereto a lever 118, shown in FIG. 1, which is connected with a piston rod 120 of a hydraulic cylinder 119 to lower the cradle arm 110 slowly when the package is removed from the cradle 202.

Figure 12:
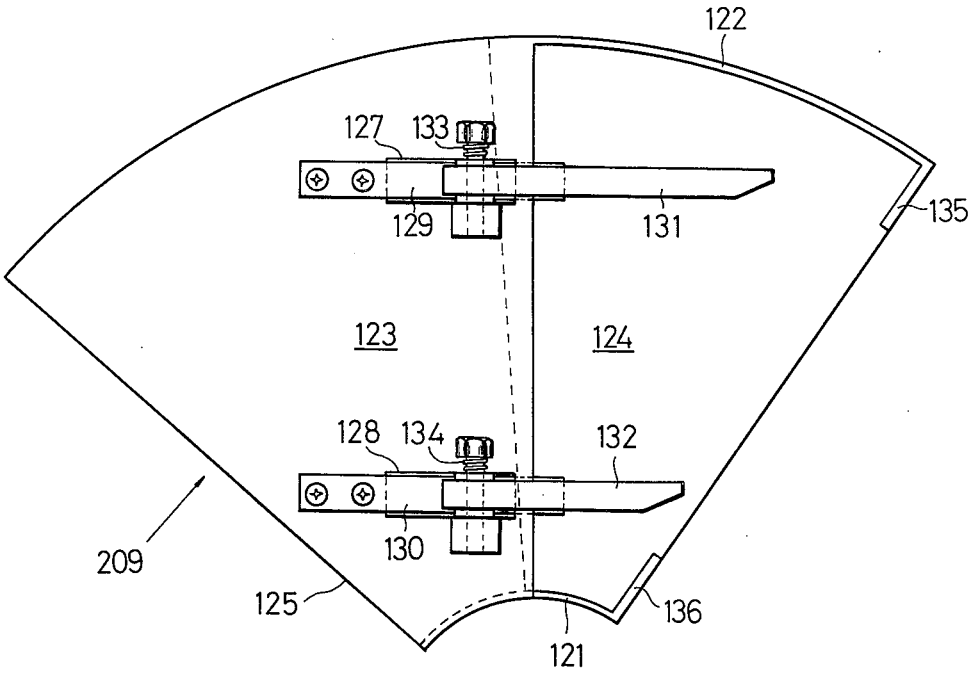
FIG. 12 shows a detailed bottom view of the empty spool container shown in FIG. 1.
Figure 13:
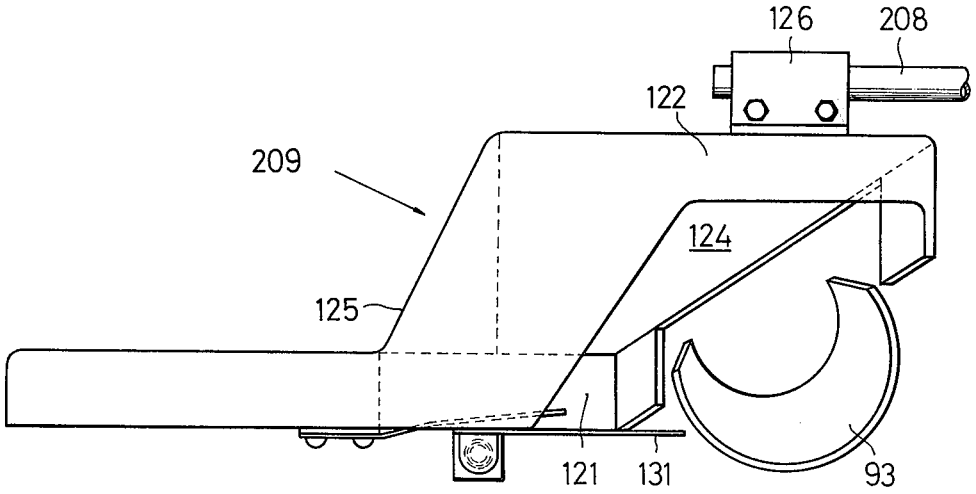
FIG. 13 shows a detailed side elevational view of the empty spool container shown in FIG. 1.

The empty spool container 209 is shown in detail in FIGS. 12 and 13. An empty spool container member 125 consisting of segmental side plates 121 and 122, a bottom plate 123 and a top plate 124 is secured with the pole 208 by a bracket 126 which is secured to the top plate 124. The bottom plate 123 has rectangular openings 127 and 128 through which project plate springs 129 and 130, respectively, which are secured to the underside of the bottom plate 123. The bottom plate 123 pivotally supports plates 131 and 132 which are urged by springs 133 and 134, respectively, toward the bottom plate 123. The top plate 124 forms spool stoppers 135 and 136 which project from the downstream end of the top plate 124.

The doffing operation of the above described yarn winding machine will hereinafter be explained.

Figure 3:
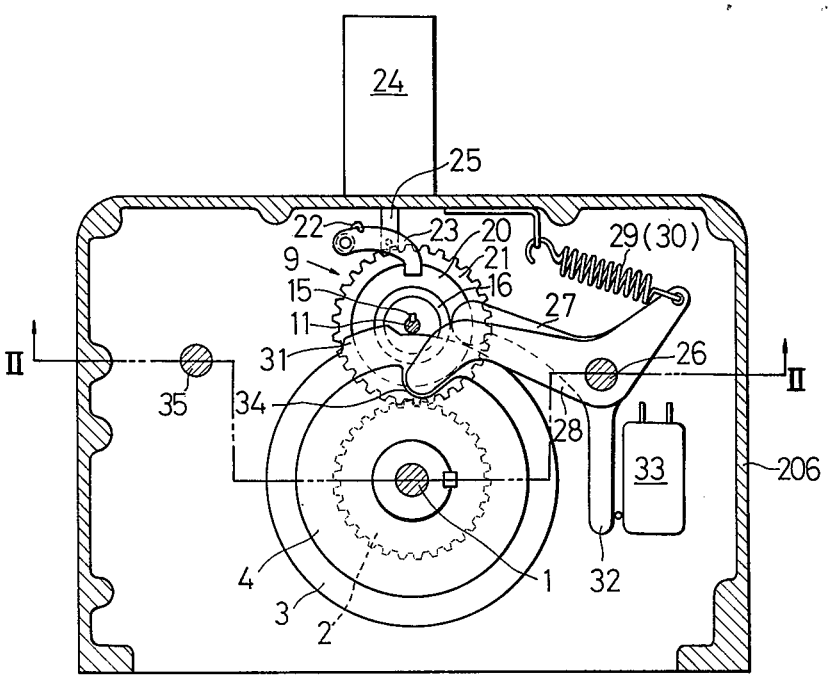
FIG. 3 shows a sectional view taken along line III—III of FIG. 2, a portion of which is eliminated.
Figure 4:
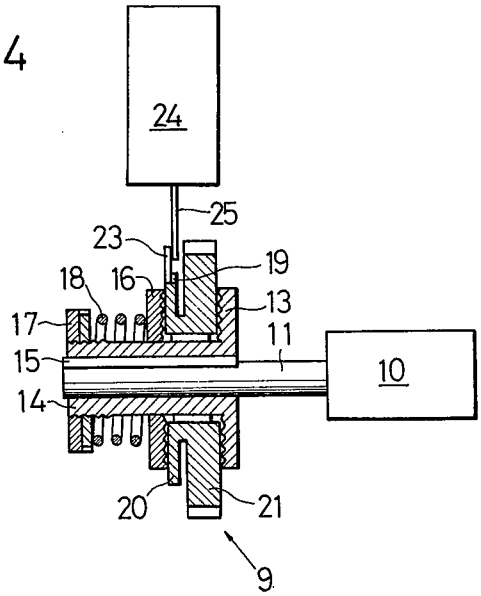
FIG. 4 shows a sectional view of one revolution clutch shown in FIG. 3.

When the package 203 is full, a limit switch, not shown, is actuated to switch off the driving motor of the guiding drum 204 and also to actuate the doffing solenoid 24 shown in FIGS. 3 and 4 to lift the pawl 23 against the spring 22. The shaft 11 of the one revolution clutch 9 is normally driven, however, while the pawl 23 engages the recess 19 of the cam 20, the friction plates 11 and 13 do not transmit the rotation of the shaft 11 to the gear 21. When the solenoid 24 is actuated to lift the pawl 23 from the recess 19 of the cam 20, the gear 21 rotates with the shaft 11 by engaging the clutch plates 13, 16. After one revolution of the shaft 11, the pawl 23 again engages in the recess 19 of the cam 20 to stop the gear 21. The gear 21 and the meshing gear 2 have the same number of teeth, so that the gear 2 also performs one revolution to rotate the cams 3, 4, 5, 6, 7 and 8 therewith. As the cam 3 rotates, the lever 27 leaves the projection 31 of the cam 3, so that the other arm 32 of the lever 27 presses the microswitch 33 to open the contacts and stop the guiding drum 204.

The rotation of the cam 5 results in the movement of the lever 36 to lower the vertical lever 38 through the lever 37. As the vertical lever 38 lowers, the lever 83 shown in FIG. 9 rotates to lower the spool holder 93. Also, the shaft 92 is rotated through the levers 97 and 98 so that the levers 90 and 91 also rotate to effect a 180° rotation of the spool holder 93 to a face downward position. When the lever 86 is engaged on the stopper, the spool holder 93 faces the cradle 202 at its spool holding position. After the cradle 202 receives the empty spool, the vertical lever 38 again moves upward and the spool holder 93 also moves upward against the urging force of the spring 95 to return to its initial position.

As the cam 6 is rotated, the lever 39 engages the recess of the cam 6. The movement of the lever 39 is transmitted through the shaft 35, and levers 40 and 41 to the guide plate 205 to rotate the same. As the projection 76 on the free end of the side plate 62 of the guide plate 61 pushes against the brake lever 80, said lever 80 urges the brake shoe 77 toward the periphery of the guiding drum 204 to stop the drum.

As the cam 7 rotates, it moves the engaging lever 47, which in turn rotates the shaft 48 through levers 50 and 49. Thus, the shutter plate 207 engages the projection 117 of the cradle arm 110 to open the same. The package 203, which has been supported by the spool supports 113 and 114, drops on the guide plate 205, and the cradle 202 moves slowly downward by means of hydraulic cylinder 119.

By sequential rotation of the cam 6, the guide plate 205 moves upward to pull the lever 74, shown in FIG. 7, to rotate the L-shaped rod 73 to effect rotation of the lever 68. Thus, the first yarn transfer lever 64 rotates clockwise. The yarn holding portion 75 of the lever 64 transfers yarn connected to the full package 203 to the cutter 82. Also, the second yarn transfer lever 55 transfers the yarn across the guiding drum 204 to release the yarn from the guiding drum 204. The yarn is transferred from the yarn holding portion 140 of the second yarn transfer lever 55 across the spool support 114 on the lever 115 and between the cutters 82 and 83 to the package 203.

Frustoconical empty spools are inserted in one row in the empty spool container member 125. When the empty spool holder 93 of the empty spool carrier 210 moves upward, the foremost spool is pressed between the top plate 124 and the holder 93 to place the empty spool in the holder 93. When the spool carrier 210 holding the spool is lowered to romove the foremost spool from the empty spool container 125, a portion of the spool held by the spool holder 93 urges the plates 131 and 132 against the springs 133 and 134 so that the rear ends of the plates 131 and 132 urge the plate springs 129 and 130 to prevent movement of the succeeding spools in the container member 125. As the spool holder 93 lowers further, the plates 131 and 132 disengage from the spool to lower the plate springs 129 and 130. Thus, succeeding empty spools move forward and the next foremost spool is supported on the plates 131 and 132 by engaging the stops 135 and 136.

The empty spool carrier 210 holding the empty spool moves downward, and the empty spool holder 93 faces downward to align the spool with the spool supports 113 and 114 of the cradle 202. Then the shutter plate 207 rotates to its initial position to close the lever 115 of the cradle 202 by urging force of the spring 116. Thus, the spool is held by spool supports 113 and 114. Also, the projection 117 of the lever 115 urges the cutter 82 on the guide plate 205 to cut the yarn connected to the full package. The empty spool carrier 210 and the guide plate 205 return to the initial position. The full package on the guide plate 205 then rolls down to the conveyor belt 137 of conveyor means 211.

As the empty spool is held by the cradle 202, the second yarn transfer lever 55 returns slightly to its initial position, and also the lever 27 engages on projection 31 of the cam 3 to close contacts of the microswitch 33 to start the guiding drum 204 and bunch winding is performed at one end of the empty spool. After the bunch winding is performed, the second yarn transfer lever 55 returns to initial position by crossing the face of the guiding drum 204 so that the yarn engages in a groove of the guiding drum 204 to start ordinary winding.

As the cams 2 through 8 complete a single counterclockwise rotation, the lever 28 enters the recess 34 in cam 4 to stop the cams 2 through 8 in the initial position thereof, and pawl 23 is reset to complete a yarn transfer cycle.

What is claimed is:

1. A doffing apparatus of an automatic winding machine having a frame, a plurality of winding units each carrying a package, conveying means to transport a full package and guiding drum means contacting the periphery of the package to drive the same, said doffing apparatus comprising guide plate means for guiding a full package to the conveying means, brake means engageable with the guiding drum means to stop the guiding drum means, means mounting the brake means adjacent the guiding plate in a position to be contacted and actuated by the guiding plate on movement of the guiding plate, means for moving the guiding plate to contact and actuate the brake means while the guiding drum means are still engaging a full package, cradle means supporting the package in contact with the guiding drum means, shutter plate means for opening the cradle means to release a full package, yarn transfer means mounted on said guide plate for transferring the yarn end connected with a full package to one end of the package, cutter means to cut said yarn end transferred by said yarn transfer means, and empty spool carrier means for carrying an empty spool to said cradle means to be supported by the cradle means.

2. The apparatus as claimed in claim 1 wherein the brake means includes switch means for actuating said brake means and first cam means for opening and closing the switch means, said empty spool carrier means including second cam means for swinging said empty spool carrier means, said shutter plate means including third cam means for moving said shutter plate, additional yarn transfer means positioned adjacent said guide plate for assisting in said yarn transfer on swinging movement thereof, fourth cam means for swinging said additional yarn transfer means, shaft means connecting said first cam means to said fourth cam means in one unit, and one revolution clutch means to connect said shaft means with said first to fourth cam means.

3. The apparatus as claimed in claim 2, wherein said means operably connecting the guide plate means with the brake means includes a projection provided at one end of the guiding plate, lever means connected to said brake means and said projection urging said lever when said guiding plate means is actuated to engage the brake means with said guiding drum.

4. The apparatus as claimed in claim 3, wherein said cutter means is mounted at one side edge of said guide plate.

5. The apparatus as claimed in claim 4, wherein said empty spool container means includes a top plate and a bottom plate between which the empty spool can pass, plate means urged by spring means occupying a portion of said bottom plate to urge the empty spool toward the top plate, and plate stop means projecting downwardly from the top plate to limit forward movement of the empty spool.

6. A doffing method for an automatic winding machine having a frame, a plurality of winding units each carrying a package including a spool and yarn wound on the spool and conveying means to transport a full package, comprising supporting a spool carried by cradle means until it is full of yarn while driving the package by contacting the periphery of the package with a guiding drum, moving a guide plate to actuate brake means to stop the guiding drum and the package on the spool becoming full, then swinging a shutter plate to open the cradle means to release the full package onto the guide plate, moving said released full package onto conveying means, and at the same time transferring yarn connected with the full package sidewise to yarn cutter means, carrying an empty spool to the cradle means and supporting the empty spool by the cradle means.

* * * * *